US010822125B2

(12) United States Patent
Knueppel et al.

(10) Patent No.: US 10,822,125 B2
(45) Date of Patent: Nov. 3, 2020

(54) METHOD FOR AUTOMATICALLY CONTROLLING THE FEED OF A FILM WEB IN A PACKAGING MACHINE

(71) Applicant: Uhlmann Pac-Systeme GmbH & Co. KG, Laupheim (DE)

(72) Inventors: Joerg Knueppel, Schwendi (DE); Thomas Haller, Waldburg (DE); Sergei Schaedlich, Ulm (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 131 days.

(21) Appl. No.: 16/252,017

(22) Filed: Jan. 18, 2019

(65) Prior Publication Data

US 2019/0241288 A1 Aug. 8, 2019

(30) Foreign Application Priority Data

Feb. 5, 2018 (EP) ..... 18155105

(51) Int. Cl.

| | |
|---|---|
| ***B65B 57/02*** | (2006.01) |
| ***B65B 9/04*** | (2006.01) |
| ***B65B 57/04*** | (2006.01) |
| ***B65B 41/18*** | (2006.01) |
| ***B65B 41/14*** | (2006.01) |
| ***B65B 41/16*** | (2006.01) |
| ***B65B 47/02*** | (2006.01) |
| ***B65B 61/02*** | (2006.01) |

(52) U.S. Cl.

CPC ..... *B65B 9/045* (2013.01); *B65B 9/04* (2013.01); *B65B 41/14* (2013.01); *B65B 41/16* (2013.01); *B65B 41/18* (2013.01); *B65B 47/02* (2013.01); *B65B 57/04* (2013.01); *B65B 61/025* (2013.01)

(58) Field of Classification Search

CPC ..... B65B 9/04; B65B 41/18; B65B 57/00; B65B 57/02

USPC ..... 53/452, 453

See application file for complete search history.

(56) References Cited

U.S. PATENT DOCUMENTS 3,276,183 A * 10/1966 Carlisle, Jr. ..... B65B 41/18 53/51
4,209,957 A * 7/1980 Utzmann ..... B29C 51/18 264/101
4,472,922 A * 9/1984 Romagnoli ..... B65B 57/10 53/508
4,575,995 A * 3/1986 Tabuchi ..... H05K 13/0038 53/453
4,860,522 A * 8/1989 Cherney ..... B65B 41/18 53/451

(Continued)

FOREIGN PATENT DOCUMENTS

EP 0 569 933 A1 11/1993
JP H05 338613 A 12/1993

OTHER PUBLICATIONS

International Search Report for European Application No. 18 155 105.2, dated Aug. 2, 2018, 2 pgs.

*Primary Examiner* — Gloria R Weeks
(74) *Attorney, Agent, or Firm* — Dickinson Wright PLLC

(57) ABSTRACT

In the method for automatically controlling the feed of a film web in a packaging machine, the feed length is controlled on the basis of specific measurements in such a way that, during following forming cycles, the acquired second distance corresponds to the first distance or deviates from the first distance by a defined amount.

20 Claims, 2 Drawing Sheets

(56) References Cited

U.S. PATENT DOCUMENTS

| | | | | |
|---|---|---|---|---|
| 4,868,759 | A * | 9/1989 | Ross | B65B 41/18 700/125 |
| 5,081,816 | A * | 1/1992 | Cardinali | B65B 61/20 53/54 |
| 5,191,693 | A * | 3/1993 | Umetsu | H05K 13/0419 29/429 |
| 5,492,465 | A * | 2/1996 | Matuzawa | B29C 51/225 188/325 |
| 6,481,187 | B1 | 11/2002 | Behnke et al. | |
| 7,392,631 | B2 * | 7/2008 | Conti | B29C 65/18 226/30 |
| 7,762,301 | B2 * | 7/2010 | Mathea | B65H 23/1882 156/378 |
| 7,770,363 | B2 * | 8/2010 | Monti | B65B 35/38 53/475 |
| 9,139,320 | B2 * | 9/2015 | Mayer | B65B 57/16 |
| 10,421,571 | B2 * | 9/2019 | Wang | B65B 15/04 |
| 2015/0096263 | A1 | 4/2015 | Ehrmann | |
| 2016/0114924 | A1 * | 4/2016 | Thring | B65B 57/04 53/51 |
| 2019/0283910 | A1 * | 9/2019 | Taguchi | B65B 57/10 |
| 2020/0172279 | A1 * | 6/2020 | Taguchi | B65B 57/06 |

* cited by examiner

METHOD FOR AUTOMATICALLY CONTROLLING THE FEED OF A FILM WEB IN A PACKAGING MACHINE

RELATED APPLICATIONS

The present disclosure claims the benefit of and priority to European Patent Application No. EP 18 155 105.2 filed Feb. 5, 2018, the entire contents of which are incorporated herein by reference.

FIELD OF THE INVENTION

The present disclosure relates to a method for automatically controlling the feed of a film web in a packaging machine.

BACKGROUND

Packaging machines are used to produce blister packs for medicinal products or packaging for food products, for example. Packaging machines of this type usually comprise work stations arranged one after the other in a production or conveying direction. The work stations include a forming station, a package-filling station, a sealing station, and a stamping station. In these stations, pockets are formed in a film web, are then filled with products and sealed with a cover film; and finally individual packages are stamped or cut from the film web.

One of the goals of packaging machines of this type is to produce a film web which is as homogeneous as possible, i.e., a web into which individual pocket arrangements have been introduced with uniform spacing between them or in predetermined patterns. This homogeneity offers various advantages. In the area of the sealing station, it is thus guaranteed that the pockets in the film web fit reliably into the recesses of the sealing tools, so that the pockets and the products contained in them are not squashed between the sealing tools. In the area of the stamping station, furthermore, it is desirable to minimize the amount of clippings or waste material generated when the individual packages are stamped out of the film web, which reduces film consumption. Irregularities in the position of the pocket arrangements of the film web mean that the film web must be provided with greater tolerances around the pocket arrangements to ensure that the pockets and the products are not damaged when the packages are stamped out. Tolerances in the feed movement of the film web or a shrinkage of the film web which deviates from the previously calculated values can lead to such irregularities or deviations in the position of the pocket arrangements of the film web.

EP 0 569 933 A1 proposes for this reason a packaging machine in which the individual work stations can be shifted in the production direction and in the direction opposite to that, so that they can be aligned with the pockets in the film web. We have found that detecting the position of the pockets and shifting each individual work station, however, involves a great deal of control effort, which is itself also susceptible to error.

BRIEF SUMMARY

It is an object of the present disclosure to provide a method by means of which a film web can be reliably produced with a homogeneous distribution of pockets.

According to an aspect of the present disclosure, a method for automatically controlling the feed of a film web in a packaging machine comprising a forming station, a product loading station, a sealing station, and a stamping station comprises the steps of:

- arranging a film web in an area of the forming station by means of a first feed means;
- introducing at least one first and one second pocket arrangement, each having at least one pocket, into the film web in the course of one forming cycle in the forming station, wherein the first pocket arrangement leads the second pocket arrangement in the conveying direction of the packaging machine, and a distance between a first predetermined element of the first pocket arrangement and a second predetermined element of the second pocket arrangement is designated a first distance;
- moving the film web in stepwise fashion relative to the forming station between a first forming cycle and a second forming cycle following the first forming cycle by a feed length in the conveying direction, wherein a distance between a third predetermined element of a pocket arrangement of the first forming cycle leading in the conveying direction and a fourth predetermined element of a pocket arrangement of the second forming cycle following said pocket arrangement of the first forming cycle is designated a second distance, wherein the first and third predetermined elements correspond with respect to their relative arrangement in the conveying direction within their associated pocket arrangements, and the second and fourth predetermined elements correspond with respect to their relative arrangement in the conveying direction within their associated pocket arrangements;
- determining the first distance;
- acquiring the second distance downstream from the forming station; and
- automatically controlling the feed length on the basis of the acquired first and second distances in such a way that, during subsequent forming cycles, the acquired second distance corresponds to the first distance or deviates from the first distance by a defined amount.

With the first alternative, it is thus achieved that the second distance between two pocket arrangements of successive forming cycles always corresponds to the first distance between two pocket arrangements of the same forming cycle, even if unexpected or unpredicted deviations occur during the production process as a result of, for example, changes in the environmental parameters. The pocket arrangements are therefore uniform distances apart both within a forming cycle and between successive forming cycles. Because the system reacts immediately to any deviations occurring between the first and the second distances, the film webs to be provided around the pocket arrangements can be configured with small tolerances, which has the effect of reducing the amount of film web which must be consumed. It is also possible to ensure the precise sealing of the film web and the precise stamping-out of the individual packages. In the second alternative, it is possible, for example, to shift the film web effectively in order to bring it into alignment with the printing on the cover film during the sealing process.

The first and second distances are preferably defined parallel to the conveying direction. This makes it possible for the method according to the invention to work reliably even when successive pockets or rows of pockets are arranged with an offset to each other in a width direction, transversely to the conveying direction of the film web.

It is preferred that the first, second, third, and fourth predetermined elements be configured as pockets of their associated pocket arrangements or as reference marks on their associated pocket arrangements. Configuring the first, second, third, and fourth predetermined elements as pockets offers the advantage that no additional elements need to be provided in the film web to make it possible to implement the method according to the invention. In addition, pockets can be easily detected in a reliable and automated manner, so that the susceptibility of the method to error is reduced. Configuring the first, second, third and fourth predetermined elements as reference marks offers the advantage that the reference marks can be configured independently of the geometry and arrangement of the pockets in such a way that they can be reliably detected. Reference marks are usually introduced into the film web together with the pockets, so that the position of a reference mark relative to the pockets of a pocket arrangement is fixed. The third predetermined element and the fourth predetermined element are preferably arranged at the same points in their associated pocket arrangements. Because of the relatively long measurement distance, deviations in the measurements thus become less important.

It is also possible, however, to configure the third and fourth predetermined elements as pockets and to arrange them so that one is directly behind the other in the conveying direction. The second distance is then to be determined, relative to the conveying direction, between a trailing pocket or row of pockets of a leading pocket arrangement of a first forming cycle and a first pocket or first row of pockets of a following pocket arrangement of a second forming cycle following the first forming cycle.

The determination of the first distance is especially easy if the determination of the first distance takes place preferably on the basis of the geometry of the forming tool, and if this first distance is stored in a control unit of the packaging machine. Because the first distance can be determined by means of the first and second predetermined elements, which are introduced for their own part into the film web jointly by the forming tool during a forming cycle, the first distance can also be predetermined on the basis of the geometry of the forming tool. This offers the advantage that the first distance does not have to be detected in a separate operation but rather can be easily called up by the control unit to automatically regulate the feed length. The first distance can be stored in the control unit for each of various forming tools, so that, as a function of the selected forming tool, the correct first distance will always be available for the automatic control of the feed length.

In an alternative embodiment, the method comprises the determination of the first distance downstream from the forming station, preferably at the same point and/or preferably in the same way as that in which the second distance is determined. Thus it also becomes possible to incorporate changes in the first distance into the automatic control of the feed length during the production process. Such changes are completely normal and are caused, for example, by shrinkage of the film web as a result of heating and cooling.

The acquisition of the second distance preferably comprises the detection of the third and fourth predetermined elements and the calculation by the control unit of the second distance from the time difference between the third and fourth predetermined elements and the feed rate of the film web. As a result, the method is simplified to the extent that it is necessary merely to detect the passage of the third and fourth predetermined elements. This is possible with conventional sensors of simple design, such as those in the form of light barriers. More complicated visual systems are not mandatory, but it may be advantageous to use them. The change in the feed rate is known to the control unit in any case, so that, to calculate the second distance, no further data are required. The acquisition of the second distance is therefore possible by the use of relatively simple and inexpensive means.

The third and fourth predetermined elements are preferably detected upstream from the stamping station, more preferably between the sealing station and the stamping station, and especially preferably directly in front of or in the stamping station. This offers the advantage that all of the deviations occurring in the production process up to the stamping station are incorporated into the automatic control of the feed length. Because in particular the stamping-out of the individual packages from the film web must be carried out very precisely to reduce the consumption of film material, it is advantageous for the feed length to be adjusted in such a way that the pocket arrangements are always positioned with the greatest possible precision in the area of the stamping station.

The packaging machine preferably comprises at least one sensor for detecting the third and fourth predetermined elements. Because sensors of this type, which in particular detect the passage of individual pockets or reference marks, are easy to integrate into a packaging machine, a low-cost possibility for determining the second distance is created.

In a preferred embodiment, the method comprises the acquisition of a deviation of the acquired second distance from the first distance by means of the control unit and the automatic control of the first feed length as a function of the determined deviation between the first distance and the second distance. This is especially advantageous, because the determined deviation correlates directly with the change in the feed length to be undertaken.

The method also preferably comprises the movement of the film web in the area of the sealing station by means of second feed means and the forming of a first festoon web accumulator between the forming station and the sealing station, wherein the sealing station preferably comprises a pair of sealing rollers. Sealing rollers are especially well adapted to the sealing of a cover film to the film web provided with the pocket arrangements. Sealing rollers are usually operated continuously. A festoon web accumulator is therefore provided in the transition area between the forming station, where the film web moves in stepwise fashion, and the sealing station, where the film web moves continuously. If the film web also moves in stepwise fashion in the area of the sealing station, such a web accumulator can also be necessary in cases where the distances by which the web is transported differ.

Finally, it is preferable for the first feed means to be arranged upstream from the first festoon web accumulator, so that the film web can move in stepwise fashion in the area of the forming station. The first feed means preferably comprises grippers or feed rollers, which move the film web in the conveying direction.

DETAILED DESCRIPTION OF SPECIFIC EMBODIMENTS

Figure 1:
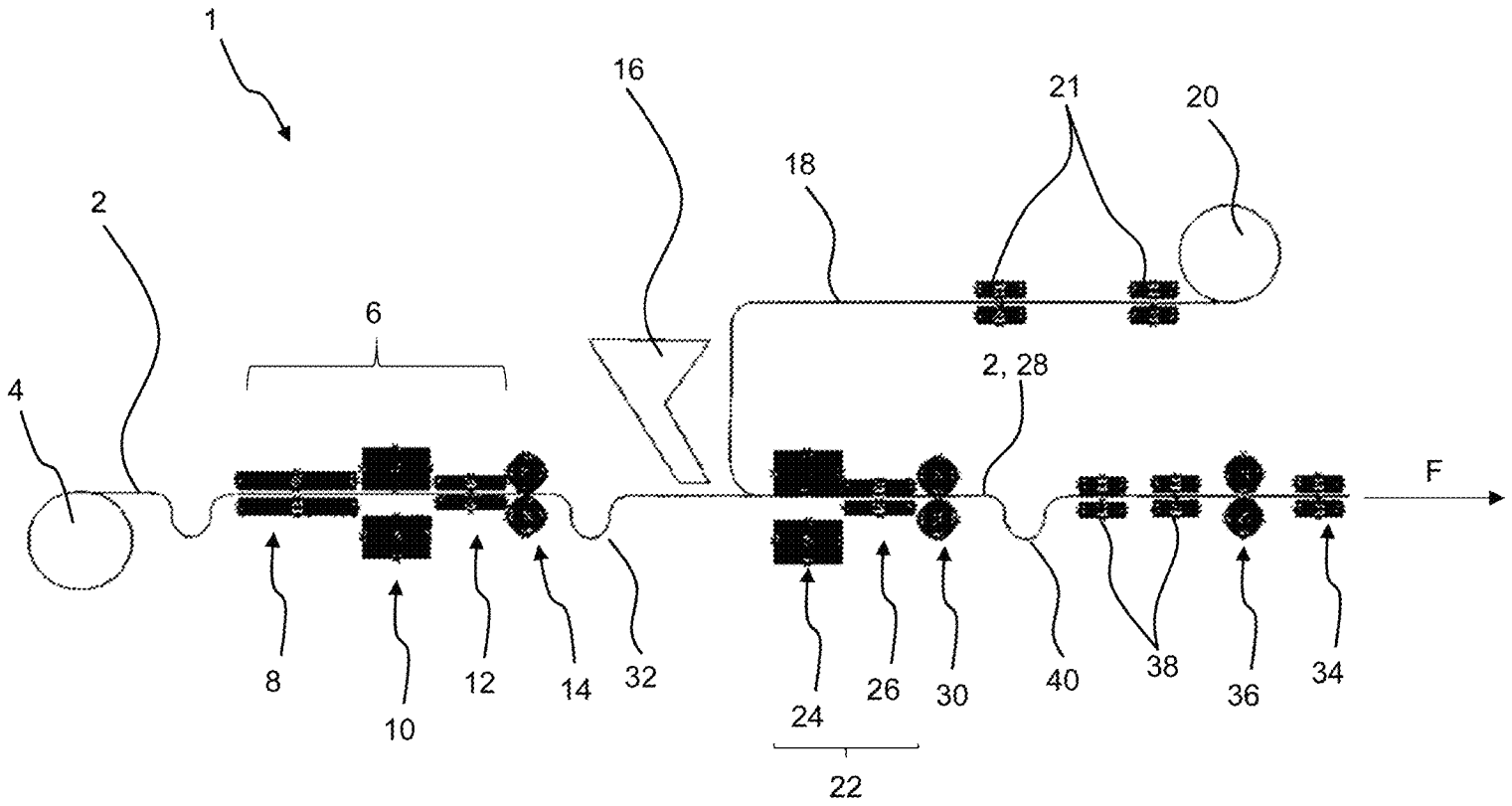
FIG. 1 shows a schematic side view of a packaging machine.

FIG. 1 shows by way of example a packaging machine in schematic fashion, to which the method according to the present disclosure for automatically controlling the feed of a film web in the packaging machine is adapted.

The packaging machine 1 comprises a plurality of work stations, through which a film web 2 passes in a conveying direction F. With respect to the conveying direction F of the film web 2, the term "upstream" in the following means in the direction opposite the conveying direction F, and the term "downstream" means in the conveying direction F.

At the beginning, the film web 2 is rolled up to form a first supply roll 4 and is conducted from this to a forming station 6. In the forming area of the forming station 6, the film web 2 is preferably heated by heating means 8. In the case of aluminum laminate film webs, the heating means 8 can be omitted. A forming device 10, which comprises deep-drawing tools, for example, then introduces pocket arrangements, each with at least one pocket, preferably several pockets, into the film web 2 to hold the product. If the film web 2 has been heated prior to the forming operation, the film web 2 is cooled by first cooling means 12 to prevent as effectively as possible the uncontrolled shrinkage of the film web. The cooling means 12 can preferably also be integrated into the forming device 10. A first feed means 14 then moves the film web 2 in the area of the forming station in stepwise fashion in the conveying direction F. The first feed means 14 can, as illustrated, be formed by one or more feed rollers. It is also conceivable, however, that grippers could be used, which grip the edges of the film web 2 and pull it in the conveying direction F.

In a product loading station 16, the products to be packaged, preferably tablets, are loaded into the pockets of the film web 2. A cover film 18 for sealing the pockets of the film web 2 is kept on hand in the form of a second supply roll 20. Means 21 for printing and straightening the cover film 18 can be provided. Downstream from the loading station 16, the cover film 18 of the film web 2 is supplied in such a way that it covers the product-filled pockets and is moved jointly with the film web 2 in the conveying direction F. In a sealing station 22, the cover film 18 is sealed to the film web 2. For this purpose, a sealing device 24 is provided, which can comprise sealing plates or sealing rollers. Following the sealing device 24, second cooling means 26 for cooling the material web 28 consisting of the cover film 18 and the film web 2 can be provided. The cooling means 26 can also be integrated into the sealing device 24. The film web 2 with the pockets will continue to be referred to in the following as the "film web", even though it has already been filled with product and sealed with a cover film so that it and the cover film form a single unit.

A second feed means 30 moves the film web 2 in the area of the sealing station 22 in the conveying direction F. The second feed means 30 can also comprise feed rollers or grippers. If the sealing device 24 is formed by sealing rollers, the film web 2 will be moved continuously in the conveying direction F in the area of the sealing station 22. To make possible the transition between the stepwise movement of the film web 2 in the area of the forming station 6 and the continuous movement of the film web 2 in the area of the sealing station 22, a first festoon web accumulator 32 is provided between the forming station 6 and the sealing station 22. If the sealing device 24 comprises sealing plates, the film web 2 will also be moved in a stepwise manner in the conveying direction F in the area of the sealing station 22. In this case, the first festoon web accumulator 32 can be omitted. The first festoon web accumulator 32, however, can also be provided as a buffer between two different cycle speeds of the forming and sealing stations 6, 22.

Finally, individual packages (such as blister packs) are stamped out from the film web 2 in a stamping station 34. A third feed means 36 moves the film web 2 preferably in stepwise fashion in the conveying direction F in the area of the stamping station 34. Upstream from the stamping station 34, it is also possible to provide means 38 for embossing and perforating the film web 2 or material web 28. If the film web 2 is moved continuously in the area of the sealing station 22 and in stepwise fashion in the area of the stamping station 34, a second festoon web accumulator 40 is provided between these stations. If the movement in the area of the sealing station 22 is stepwise, it can also be necessary to provide such an accumulator if the distances by which the web is transported differ.

The packaging machine 1 usually also comprises means for detecting pockets in the film web 2 and for detecting products in the pockets of the film web 2 for the purposes of process control and quality assurance. Means for detecting pockets are arranged downstream from the forming station 6 as appropriate.

It is obvious that the description of the packaging machine 1 serves merely to illustrate the method according to the invention. The concrete arrangement of the individual stations or devices and their configuration and mode of operation are familiar to the skilled person and can be adapted to the requirements present in the individual case.

Figure 2:
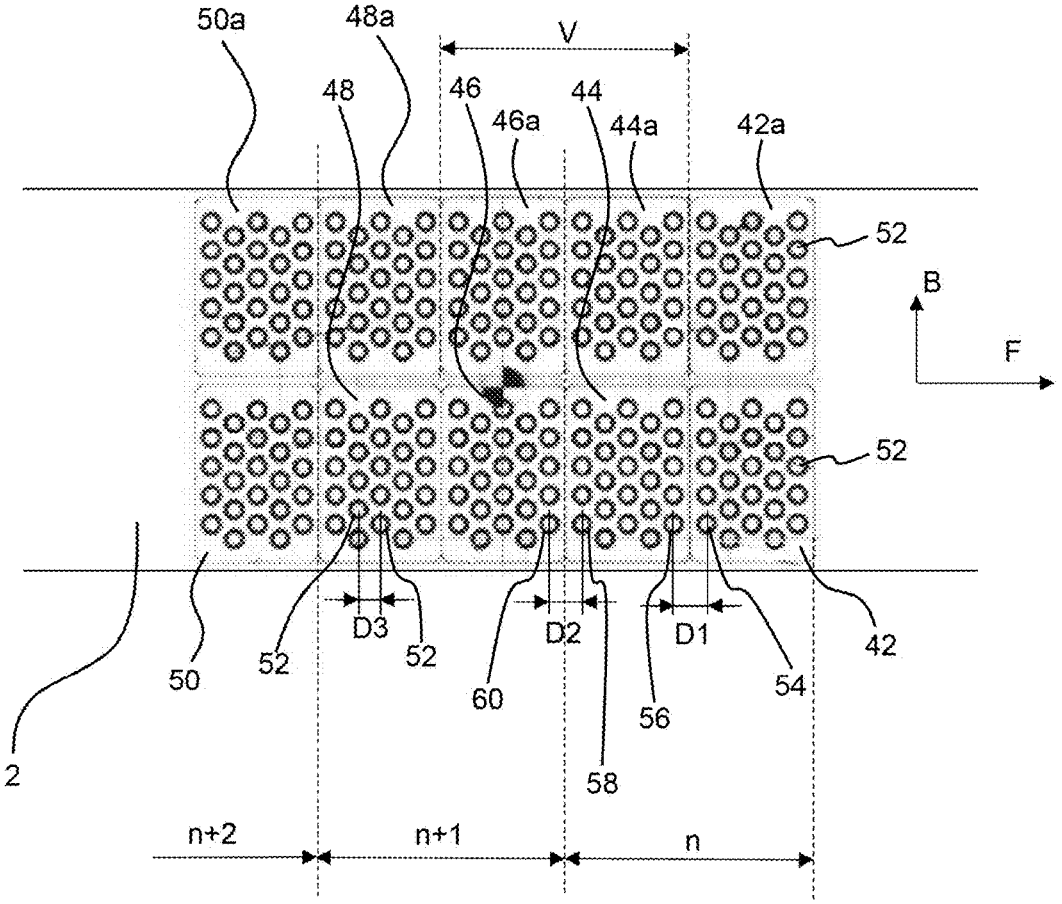
FIGS. 2 and 3 show schematic plan views of a section of a film web in the packaging machine according to FIG. 1.

FIG. 2 shows a plan view of a section of the film web 2, as it appears downstream from the forming station 6 and upstream from the stamping station 34. This means that products can preferably already be present in the pockets of the film web 2 and that the film web 2 can already be sealed with the cover film 18, even though this is not shown for the sake of clarity.

A first pocket arrangement 42, a second pocket arrangement 44, a third pocket arrangement 46, a fourth pocket arrangement 48, and a fifth pocket arrangement 50 are introduced into the film web 2 in the conveying direction F. In a width direction B, which extends in the plane of the film web 2 transversely to the conveying direction F, several rows of pocket arrangements can be introduced, one next to the other, into the film web 2. In the embodiment shown here, two rows of pocket arrangements are introduced into the film web next to each other in the width direction B, wherein the second row comprises the pocket arrangements 42*a*, 44*a*, 46*a*, 48*a*, and 50*a*.

For the sake of clearer illustration and for differentiating the pocket arrangements from each other, a box is drawn around each of the pocket arrangements 42, 44, 46, 48, 50, 42*a*, 44*a*, 46*a*, 48*a*, 50*a*. It is also conceivable that the boxes could illustrate the contours of the (blister) packs to be stamped out in the stamping station 34.

Each of the pocket arrangements 42, 44, 46, 48, 50, 42*a*, 44*a*, 46*a*, 48*a*, 50*a* comprises at least one pocket 52, preferably a plurality of pockets 52. The pockets 52 have been introduced into the film web 2 by means of the forming device 10 and serve to hold the products to be packaged. In the exemplary embodiment shown here, each pocket arrangement comprises five rows of pockets containing five pockets each, arranged one behind the other in the conveying direction F. It is obvious that a particular pocket arrangement can comprise any desired number of pockets arranged in a freely selectable manner.

The pocket arrangements 42, 44, 46, 48, 50 shown in FIG. 2 are also divided in the conveying direction F into areas designated n, n+1, and n+2. Each area n, n+1, n+2 comprises the pocket arrangements which have been introduced into the film web 2 in one forming cycle n, n+1, n+2 of the forming station 6. For example, the first pocket arrangement 42, the second pocket arrangement 44, and the pocket arrangements 42*a* and 44*a* were introduced during the first forming cycle n of the forming station 6. The third pocket arrangement 46, the fourth pocket arrangement 48, and the pocket arrangements 46*a* and 48*a* were introduced into the film web during the second forming cycle n+1 of the forming station, i.e., during the cycle following the first forming cycle n. This can be repeated for any desired number of forming cycles n+i, wherein only two pocket arrangements 50, 50*a* are shown for the third forming cycle n+2. During each forming cycle from n to n+i, at least two pocket arrangements, each with at least one pocket 52, are introduced into the film web 2. Two-to-six pocket arrangements are usually introduced into the film web 2 during each forming cycle. Between two successive forming cycles n, n+1, the film web 2 is moved by the first feed means 14 in the conveying direction F by a feed length V.

Each pocket arrangement also comprises at least one predetermined element, which is employed to control the feed of the film web. In particular, a predetermined element can be formed by a pocket or by a reference mark. In the embodiment illustrated here, the first pocket arrangement 42 comprises a first predetermined element 54, and the second pocket arrangement 44, which comes next in the conveying direction F, comprises a second predetermined element 56. The first and second predetermined elements 54, 56 are always assigned to two pocket arrangements arranged one behind the other in the conveying direction F. If, for example, a forming cycle comprises three pocket arrangements arranged one behind the other in the conveying direction F, the first predetermined element 54 can be assigned to the pocket arrangement in the leading position relative to the conveying direction F, and the second predetermined element 56 can be assigned to the pocket arrangement following the leading pocket arrangement. The first predetermined element 54, however, can also be assigned to the pocket arrangement in the middle, relative to the conveying direction F, of three pocket arrangements, so that the second predetermined element 56 will be assigned to the third pocket arrangement, which follows the middle one. The distance between the first predetermined element 54 and the second predetermined element 56 is referred to as "first distance D1". The first distance D1 thus represents the distance between the two pocket arrangements of the same forming cycle.

A pocket arrangement of a first forming cycle which is followed in the conveying direction F by a pocket arrangement of a following forming cycle comprises a third predetermined element 58. The pocket arrangement of the following forming cycle comprises a fourth predetermined element 60. In the exemplary embodiment being described here, therefore, the second pocket arrangement 44 of the first forming cycle n comprises the third predetermined element 58, and the third pocket arrangement 46 belonging to the second forming cycle n+1 comprises the fourth predetermined element 60, wherein the third pocket arrangement 46 follows directly after the second pocket arrangement 44 relative to the conveying direction F. The distance between the third predetermined element 58 and the fourth predetermined element 60 is called the "second distance D2". The second distance D2 therefore represents the distance between two pocket arrangements of successive forming cycles.

As can be derived from FIG. 2, the first and the third predetermined elements 54, 58 are in corresponding positions with respect to their relative arrangement in the conveying direction F within their associated pocket arrangements 42, 44. That is, the first predetermined element 54 assumes the same position, at least in the conveying direction F, within the first pocket arrangement 42 as the third predetermined element 58 does within the second pocket arrangement 44. The relative position of the first predetermined element 54 within the first pocket arrangement 42 preferably agrees with the relative position of the second predetermined element 56 within the second pocket arrangement 44 not only in the conveying direction F but also in the width direction B.

The second and fourth predetermined elements 56, 60 are also in corresponding positions with respect to their relative arrangement in the conveying direction F within their associated pocket arrangements 44, 46. That is, the second predetermined element 56 assumes the same position, at least in the conveying direction F, within the second pocket arrangement 44 as the fourth predetermined element 60 does within the third pocket arrangement 46. The relative position of the second predetermined element 56 within the second pocket arrangement 44 preferably agrees with the relative position of the fourth predetermined element 60 within the third pocket arrangement 46 not only in the conveying direction but also in the width direction B.

If, as shown in the exemplary embodiment according to FIG. 2, a pocket arrangement comprises at least two pockets 52 arranged one behind the other in the conveying direction F or at least two rows of pockets arranged one behind the other in the conveying direction F and extending in the width direction B, the distance between two pockets 52 of a pocket arrangement arranged one behind the other in the conveying direction F is designated the "third distance D3".

The first distance D1, the second distance D2, and the third distance D3 are preferably defined parallel to the conveying direction F. The first distance D1, the second distance D2, and the third distance D3 are therefore to be determined in the conveying direction F, even if the predetermined elements between which the distance in question is to be determined are arranged with an offset from each other in the width direction B.

Each of the first, second, third, and fourth predetermined elements 54, 56, 58, 60 can be configured as a pocket 52 of a pocket arrangement 42, 44, 46, 48. The pockets 52 formed in a film web 2 are usually readily detectable by optical or mechanical means, so that the distance between two predetermined pockets 52 can be easily determined. For example, ascending and/or descending sides of the pockets can be measured. The measurement can be conducted by means of light barriers working perpendicularly to the transport direction; these barriers detect the pockets as they pass by; it can also be conducted by means of cameras, which detect the contour of the pockets from below, or by means of other sensors, of which there are many types.

The first, second, third, and fourth elements 54, 56, 68, 60, however, can also be configured as reference marks. Such reference marks are preferably introduced into the film web 2 in the forming station 6 together with the pockets 52, so that their positions relative to the pockets 52 are predetermined. Reference marks can be formed, for example, by embossing the film web 2, by making through-holes in the film web 2, or by printing marks onto the web. Reference marks are especially well adapted to serving as predetermined elements 54, 56, 68, 60 when the pocket geometry makes it difficult to detect the pockets 52 or when the relationships within the packaging machine 1, e.g., accessibility, makes it difficult or impossible to detect the pockets 52.

Figure 3:
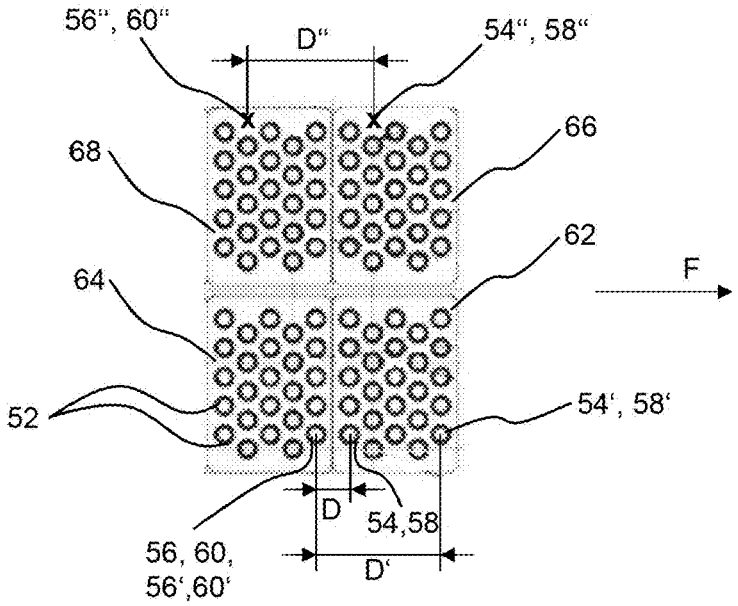

FIG. 3 shows by way of example a sixth, seventh, eighth, and ninth pocket arrangement 62, 64, 66, 68, to illustrate various possibilities for the configuration of the predetermined elements 54, 56, 68, 60 and various relative arrangements of those elements. The sixth and seventh pocket arrangements 62, 64 are arranged one behind the other in the conveying direction F, wherein the sixth pocket arrangement 62 is in the leading position. Offset in the width direction B, the eighth and ninth pocket arrangement 66, 68 are arranged one behind the other in the conveying direction F, wherein the eighth pocket arrangement 66 is in the leading position. As previously described, the first and third predetermined elements 54, 58 are in corresponding positions with respect to their relative locations within their pocket arrangements in the conveying direction F, and the second and fourth predetermined elements 55, 60 are also in corresponding positions in the conveying direction.

The illustrated distances D, D', and D" can correspond both to the first distance D1 and to the second distance D2. If the sixth pocket arrangement 62 corresponds to, for example, the first pocket arrangement 42 and the seventh pocket arrangement 64 corresponds to the second pocket arrangement 44 according to FIG. 2, then the illustrated distances D, D', and D" show various possibilities for the first distance D1. If, however, the sixth pocket arrangement 62 corresponds to the second pocket arrangement 44 and the seventh pocket arrangement 64 corresponds to the third pocket arrangement 46, then the distances D, D', D" show various possibilities for the second distance D2.

If the predetermined elements 54, 56, 58, 60 are configured as pockets 52, it is possible for the first or third predetermined element 54, 58 of the sixth pocket arrangement 62 and for the second or fourth predetermined element 56, 60 of the seventh pocket arrangement 64 to be arranged one directly behind the other in the conveying direction F. That is, the first or third predetermined element 54, 58 is a last pocket 52, relative to the conveying direction F, of the sixth pocket arrangement 62, and the second or fourth predetermined element 60 is a first pocket 52 of the seventh pocket arrangement 64.

Alternatively, the distance can also be formed between any other pockets of the associated pocket arrangements. For example, the distance D' can be present between pockets 52 which are formed at the very front in the conveying direction F of their associated pocket arrangements. In this case, the distance D' is formed between a first or third predetermined element 54', 58', which is formed by a pocket 52 of the sixth pocket arrangement 62 in the front-most row in the conveying direction F, and a second or fourth predetermined element 56', 60', which is formed by a pocket of the seventh pocket arrangement 64 of the front-most row in the conveying direction F. In an arrangement of this type, the second and third elements are identical.

By way of example, predetermined elements 54", 56", 58", 60", which are configured as reference marks, are illustrated on the basis of the eighth and ninth pocket arrangements 66 and 68. The distance D" is formed between the reference mark 54", 58" of the leading eighth pocket arrangement 66 and the reference mark 56", 60" of the following, i.e., ninth, pocket arrangement 68. It is obvious that a reference mark can be configured in any desired position within the associated pocket arrangement. In the arrangement shown here, the second and third elements are identical.

It is also possible to define certain of the elements 54, 54', 54", 56, 56', 56", 58, 58', 58", 60, 60', 60" as reference marks and certain others as pockets.

According to the method of the invention, the film web 2 is first arranged in the area of the forming station 6 by means of the first feed means 14. In the forming station 6, at least the first and second pocket arrangements 42, 44, each with at least one pocket 52, are introduced into the film web 2 in a forming cycle n of the forming station 6. In the usual case, two-to-six pocket arrangements are introduced into the film web in one forming cycle, wherein each pocket arrangement comprises a plurality of pockets, which are arranged in at least one row. The first pocket arrangement 42 precedes the second pocket arrangement 44 in the conveying direction F of the packaging machine 1. The first predetermined element 54 and the second predetermined element 56 are assigned to two successive pocket arrangements of the one forming cycle and are preferably configured as pockets 52. They are preferably arranged as shown in the example of distance D according to FIG. 3.

Because the first and predetermined elements 54, 56 are introduced into the film web 2 by the forming device 10 of the forming station 6 in the same forming cycle, the first distance D1 is specified in advance by the geometry of the forming tool of the forming station 6. That is, the first distance D1 can be determined on the basis of the geometry of the forming tool and stored in a control unit (not shown) of the packaging machine 1. Because of the shrinkage of the film web 2, however, changes in the first distance D1 can occur within the packaging machine 1 along the conveying direction F. So that these changes of the first distance D1 can be detected, i.e., so that this first distance D1 vital to the control of the packaging machine 1 can be used for automatic control purposes, the first distance D1 can also be determined downstream from the forming station 6 by sensors or cameras.

After the pocket arrangements of the first forming cycle n, i.e., at least the first and second pocket arrangements 44, 46, have been introduced into the film web 2, the film web 2 is moved by a feed length V in the conveying direction F between the first forming cycle n and the second forming cycle n+1 following the first. Then the pocket arrangements of the second forming cycle n+1 are introduced into the film web 2.

Because of the shrinkage of the film or because tolerances or errors in the feed movement of the film web 2 and thus of the feed length V, it can happen that, in spite of the previous calculation, the second distance D2 can be unequal to the first distance D1, as a result of which an inhomogeneous film web is produced. So that it is possible to produce a film web 2 which is as homogeneous as possible, however, it is desirable that the second distance D2 be equal to the first distance D1.

The method therefore comprises the determination of the first distance D1, the acquisition of the second distance D2, and the automatic control of the feed length V in such a way that, for the following forming cycles n+i, the acquired second distance D2 corresponds to the first distance D1. The determination of the first distance D1 can, as previously described, be carried out by calling up a value stored in the control unit.

The acquisition of the second distance D2 is carried out downstream from the forming station 6 and preferably comprises the acquisition of the second distance D2 by detection of the third and fourth predetermined elements 58, 60. For example, the third and fourth elements 58, 60 can be detected by sensors or cameras, which detect the passage of the third and fourth elements 58, 60. The third and fourth elements 58, 60 are preferably detected upstream from the stamping station 34, more preferably directly upstream from the sealing station 22 or directly upstream from the stamping station 34. The greatest advantage is obtained by detecting the second distance D2 after the sealing step in the sealing station 22. It is especially effective to arrange appropriate means for detecting the predetermined elements in these positions.

The second distance D2 is calculated by the control unit from, for example, the time difference between the third and fourth elements 58, 60 and the feed rate of the film web 2. Because the control unit actuates a servo motor for driving the feed means, the control unit can also use the data of the servo motor to determine the times at which the third and fourth elements 58, 60 pass by and thus to measure the interval between the pass-by times of the third and fourth elements 58, 60.

The determination of the first distance D1 can, as previously described, be carried out by calling up a value stored in the control unit. Preferably, however, the first distance D1 is acquired in a manner similar to that used for the second distance D2, wherein the first and second elements 54, 56 take the place of the third and fourth elements 58, 60.

In addition, the control unit can determine a deviation between the acquired second distance D2 and the first distance D1 and automatically control the first feed length V as a function of the acquired deviation between the first and second distances D1, D2.

Additional means for detecting the predetermined elements 54, 56, 58, 60 in the form of pockets or reference marks and the evaluation of the data thus obtained are familiar to the skilled person and can be employed without further effort to implement the method according to the invention.

The invention has been described up to this point by reference to a forming station 6, a product loading station 16, a sealing station 22, and a stamping station 34. It is also possible for more than one of each of these stations to be present. If ampoules or vials, for example, are being produced, the sealing station 22 can be omitted in many embodiments, because there is no need for a cover film 18.

Up to this point, the invention has been described on the basis of a stationary forming station. It is also possible, however, that the forming station 6 could be moved along with the film web 2 as the web is being formed and that it be moved back to the starting position again after the forming step is complete. In a case such as this, the movement of the film web 2 relative to the forming station 6 between individual forming cycles is accomplished by a type of movement different from the conventional one.

The invention claimed is:

1. A method for automatically controlling the feed of a film web in a packaging machine, which comprises a forming station, a product loading station, and a stamping station, the method comprising the steps of:

arranging a film web in an area of the forming station by means of a first feed means;

introducing at least one first and one second pocket arrangement, each having at least one pocket, into the film web in a forming cycle of the forming station, wherein the first pocket arrangement leads the second pocket arrangement in a conveying direction of the packaging machine, and wherein a distance between a first predetermined element of the first pocket arrangement and a second predetermined element of the second pocket arrangement is designated a first distance;

moving the film web in stepwise fashion relative to the forming station between a first forming cycle and a second forming cycle following the first forming cycle by a feed length in the conveying direction, wherein a distance between a third predetermined element of a pocket arrangement of the first forming cycle leading in the conveying direction and a fourth predetermined element of a pocket arrangement of the second forming cycle following said pocket arrangement of the first forming cycle is designated a second distance, wherein the first and third predetermined elements are in corresponding positions with respect to their relative arrangement in the conveying direction within their associated pocket arrangements, and the second and fourth predetermined elements are in corresponding positions with respect to their relative arrangement in the conveying direction within their associated pocket arrangements;

determining the first distance;

acquiring the second distance downstream from the forming station; and automatically controlling the feed length on the basis of the acquired first distance and second distance in such a way that, during following forming cycles, the acquired second distance corresponds to the first distance or deviates from the first distance by a defined amount.

2. The method according to claim 1, wherein the first and second distances are defined parallel to the conveying direction.

3. The method according to claim 1, wherein the first, second, third, and fourth predetermined elements are each configured as a pocket of the associated pocket arrangement or as a reference mark of the associated pocket arrangement.

4. The method according to claim 3, wherein the third and fourth predetermined elements are each arranged at a same point in their associated pocket arrangement.

5. The method according to claim 4, wherein the first and second predetermined elements are each also arranged at a same point in their associated pocket arrangement.

6. The method according to claim 1, wherein determining the first distance is carried out on the basis of a geometry of the forming tool, and the first distance is stored in a control unit of the packaging machine.

7. The method according to claim 1, wherein determining the first distance comprises detecting the first and second predetermined elements downstream from the forming station.

8. The method according to claim 7, wherein determining the first distance comprises detecting the first and second predetermined elements upstream from the stamping station.

9. The method according to claim 8, wherein the packaging machine includes a sealing station, and wherein determining the first distance comprises detecting the first and second predetermined elements between the sealing station and the stamping station.

10. The method according to claim 7, wherein the packaging machine comprises at least one sensor or a camera for detecting the third and fourth predetermined elements.

11. The method according to claim 10, wherein the sensor or the camera also serves to detect the first and second predetermined elements.

12. The method according to claim 1, wherein acquiring the second distance comprises detecting the third and fourth predetermined elements and then calculating the second distance by the control unit from a time difference between the third and fourth predetermined elements and a feed rate of the film web.

13. The method according to claim 12, wherein detecting the third and fourth predetermined elements is carried out upstream from the stamping station.

14. The method according to claim 12, wherein the packaging machine comprises at least one sensor or a camera for detecting the third and fourth predetermined elements.

15. The method according to claim 13, wherein the packaging machine includes a sealing station, and wherein detecting the third and fourth predetermined elements is carried out between the sealing station and the stamping station.

16. The method according to claim 1, further comprising acquiring a deviation of the acquired second distance from the first distance by means of the control unit and automatically controlling the feed length as a function of the acquired deviation between the first and second distances.

17. The method according to claim 1, wherein the packaging machine includes a sealing station, and further comprising moving the film web in an area of the sealing station by means of a second feed means and forming a first festoon web accumulator between the forming station and the sealing station.

18. The method according to claim 17, wherein the sealing station comprises a pair of sealing rollers.

19. The method according to claim 17, wherein the first feed means is arranged upstream from the first festoon web accumulator.

20. The method according to claim 1, wherein the first feed means comprises grippers or feed rollers, which move the film web in the conveying direction.

* * * * *